United States Patent [19]

Roberts

[11] 4,411,805

[45] Oct. 25, 1983

[54] N,N',N''-TRISUBSTITUTED-BIS-(P-AMINO-BENZYL) ANILINES AS ANTIOXIDANTS

[75] Inventor: John T. Roberts, Arlington Heights, Ill.

[73] Assignee: UOP Inc., Des Plaines, Ill.

[21] Appl. No.: 338,444

[22] Filed: Jan. 8, 1982

[51] Int. Cl.[3] ..... C10M 1/38

[52] U.S. Cl. ..... 252/47; 252/50; 252/51.5 R; 252/401; 252/402; 252/403

[58] Field of Search ..... 252/47, 50, 51.5 R, 252/401, 402, 403

[56] References Cited

U.S. PATENT DOCUMENTS

| | | | |
|---|---|---|---|
| 2,511,746 | 6/1950 | Smith et al. | 252/50 |
| 2,511,750 | 6/1950 | Smith et al. | 252/50 |
| 3,216,939 | 11/1965 | Cyba | 252/50 |
| 3,634,248 | 1/1972 | Andress, Jr. | 252/50 X |
| 3,779,923 | 12/1973 | Gardiner | 252/50 |

*Primary Examiner*—Andrew Metz

*Attorney, Agent, or Firm*—James R. Hoatson, Jr.; Eugene I. Snyder; William H. Page, II

[57] ABSTRACT

A class of N,N',N''-trisubstituted bis-(p-aminobenzyl-)anilines are found to be effective antioxidants in a broad spectrum of petroleum and petroleum related products. Trialkyl, tri(arylmethyl), and tri(heteroaryl-methyl) substituted materials of the parent compound are especially effective at concentrations as low as about 0.0005 percent by weight.

21 Claims, No Drawings

N,N',N''-TRISUBSTITUTED-BIS-(P-AMINOBENZYL) ANILINES AS ANTIOXIDANTS

BACKGROUND OF THE INVENTION

A persistant problem common to virtually all petroleum products and petroleum-related products is their tendency to undergo oxidative degradation. Oxidation may occur even under the relatively mild conditions attending storage and transport, and is appreciably accelerated when operating conditions are conductive to oxidation processes, for example, the elevated temperatures experienced by lubricating oil. Such oxidative processes not only cause chemical degradation of the petroleum or petroleum-related product, but may also cause appreciable changes in desirable physical properties, such as viscosity, which lead to a deterioration of product performance characteristics. Additionally, the oxidative products themselves may attack materials in contact with the petroleum and petroleum-related products, such as metals in contact with transmission or lubricating oils, thereby causing inefficient performance and, in extreme cases, even mechanical failure.

It has been found that certain N,N',N''-trisubstituted derivatives of bis-(p-aminobenzyl)anilines are effective antioxidants in the aforementioned products at relatively low levels. The materials have the further advantage of admitting to structural variations within broad, but nonetheless well defined, limits thereby permitting optimization of antioxidant properties for a particular product in a specified use.

SUMMARY OF THE INVENTION

The principal object of this invention is to provide a method of inhibiting oxidation in petroleum products and petroleum-related products by the addition thereto of effective amounts of additives having antioxidant properties, and compositions therefor. An embodiment of this invention comprises the use of a N,N',N''-trisubstituted bis-(p-aminobenzyl)aniline as an addition in said products. In a more specific embodiment the nitrogen substituent is a saturated alkyl moiety containing up to about 20 carbon atoms. In a further specific embodiment the nitrogen substituent is an arylmethyl moiety. In still another specific embodiment the nitrogen substituent is a pyridinylmethyl group. Depending upon its intended use, the additives are present at a concentration from about 0.0005 to about 5 wt. %.

DESCRIPTION OF THE INVENTION

The invention described herein is a method of inhibiting oxidation in petroleum and petroleum-related products selected from the group consisting of lubricating oils, greases, plastics and rubbers comprising adding to said products oxidation inhibiting amounts of the antioxidant materials of this invention, and compositions therefor. The materials of this invention which possess the highly desirable antioxidant properties claimed have the structure,

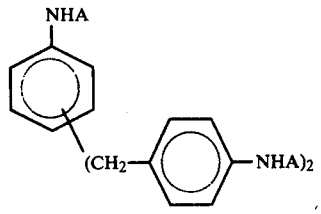

In one embodiment of this invention A is a saturated alkyl moiety containing up to about 20 carbon atoms. In other embodiments A is an arylmethyl or heteroarylmethyl moiety of the formula —$CH_2X$, where X is a monovalent radical whose parent is selected from the group consisting of unsubstituted and ring-substituted aromatic and heteroaromatic rings (i.e., aromatic heterocycles). A discovery of this invention is that the materials herein have potent antioxidant properties and can be effectively used as an additive to retard and inhibit oxidation in petroleum products and petroleum-related products at concentrations as low as about 0.0005 wt. %.

As mentioned previously, the antioxidants of this invention are bis-(p-aminobenzyl)anilines. Although all such disubstituted anilines are intended to be within the scope of this invention, the 2,4-bis-(p-aminobenzyl)anilines are particularly preferred materials. However, it should be explicitly understood that reference to such 2,4-disubstituted anilines is not meant to exclude other positional isomers.

In one embodiment of this invention the group represented by A in the above structure is a saturated alkyl moiety containing up to about 20 carbon atoms. Alkyl moieties containing up to about 10 carbon atoms are preferred, with those containing up to about 5 carbon atoms being especially preferred. The alkyl group may be linear or branched with branched groups being somewhat preferred because of increased solubility of the resulting antioxidant in the products to be protected. Examples of alkyl moieties which may be used in this embodiment of our invention include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and eicosyl groups. Among the suitable branched, saturated alkyl moieties, cited for illustrative purposes only, are isopropyl, 2-butyl, tert-butyl, 2-methyl-1-propyl, 2-pentyl, 3-pentyl, 2-methyl-1-butyl, 3-methyl-1-butyl, 3-methyl-2-butyl, 2-methyl-2-butyl, and 2,2-dimethyl-1-propyl.

In another embodiment of this invention the group represented by A in the above structure is an arylmethyl or heteroarylmethyl moiety. That is to say, A represents the group —$CH_2X$, where X is a monovalent radical whose parent is an aromatic or heteroaromatic ring and which is derived from said parent by removal of a hydrogen from a carbon atom of said ring. By "heteroaromatic ring" is meant an aromatic heterocycle, that is, a heterocyclic system commonly identified as having aromatic properties because of a $(4n+2)$ delocalized electron system in its ring, n being an integer, most commonly 1. Because of such rings include benzene, naphthalene, anthracene, chrysene, pyridine, thiophene, pyrrole, furan, imidazole, oxazole, thiazole, quinoline, carbazole, pyrimidine, purine, and so forth. Where X is the univalent radical from the benzene ring, viz., a phenyl group, it will be recognized that the resulting material is N,N',N''-tribenzyl-2,4-bis-(aminobenzyl)aniline. In other cases, it will be recognized that the resulting materials are aromatic and heteroaromatic analogs of the foregoing aniline. The heteroaromatic analogs often are especially desirable materials in this invention, and among these analogs the compounds where the parent of X is pyridine, furan, or thiophene are particularly preferred.

In some cases it is advantageous to have the aromatic or heteroaromatic ring bearing at least one substituent. Among those substituents often leading to enhanced desirable properties are halogen, especially chlorine, nitro, cyano, carboxyl, and hydroxyl moieties. Another class of substituents which may be effectively used in the materials described herein comprises alkyl, alkoxy, and alkylmercapto where the carbonaceous portion contains up to about 18 carbon atoms. Examples of the latter include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl. The carbonaceous portion is saturated and may be either a straight or branched chain, although a branched chain is preferred because of increased solubility in products where their use is intended.

The following are examples of suitable oxidants according to the invention herein and are cited for illustrative purposes only. The designation of the disubstituted aniline as the 2,4-isomer is for convenience only; other positional isomers are intended to be subsumed by the designated isomer, although not necessarily with equivalent results.

N,N',N''-trimethyl-2,4-bis-(aminobenzyl)aniline;
N,N',N''-triethyl-2,4-bis-(aminobenzyl)aniline;
N,N',N''-tripropyl-2,4-bis-(aminobenzyl)aniline;
N,N',N''tributyl-2,4-bis-(aminobenzyl)aniline;
N,N',N''-tripentyl-2,4-bis-(aminobenzyl)aniline;
N,N',N''-trihexyl-2,4-bis-(aminobenzyl)aniline;
N,N',N''triheptyl-2,4-bis-(aminobenzyl)aniline;
N,N',N''-trioctyl-2,4-bis-(aminobenzyl)aniline;
N,N',N''-trinonyl-2,4-bis-(aminobenzyl)aniline;
N,N',N''-tridecyl-2,4-bis-(aminobenzyl)aniline;
N,N',N''-tritetradecyl-2,4-bis-(aminobenzyl)aniline;
N,N',N''-trioctadecyl-2,4-bis-(aminobenzyl)aniline;
N,N',N''-trieicosyl-2,4-bis-(aminobenzyl)aniline;
N,N',N''-tribenzyl-2,4-bis-(aminobenzyl)aniline;
N,N',N''-trinaphthalenylmethyl-2,4-bis-(aminobenzyl)aniline;
N,N',N''-trianthracenylmethyl-2,4-bis-(aminobenzyl-)aniline;
N,N',N''-pyridinylmethyl-2,4-bis-(aminobenzyl)aniline;
N,N',N''-trithienylmethyl-2,4-bis-(aminobenzyl)aniline;
N,N',N''-tripyrrolylmethyl-2,4-bis-(aminobenzyl)aniline;
N,N',N''-trifuranylmethyl-2,4-bis-(aminobenzyl)aniline;
N,N',N''-trioxazolylmethyl-2,4-bis-(aminobenzyl)aniline;
N,N',N''-trithiazolylmethyl-2,4-bis-(aminobenzyl-)aniline;
N,N',N''-tri(methoxybenzyl)-2,4-bis-(aminobenzyl-)aniline;
N,N',N''-tri(ethoxybenzyl)-2,4-bis-(aminobenzyl)aniline; and so on;
N,N',N''-tri(chlorobenzyl)-2,4-bis-(aminobenzyl)aniline;
N,N',N''-tri(methylbenzyl)-2,4-bis-(aminobenzyl)aniline;
N,N',N''-tri(ethylbenzyl)-2,4-bis-(aminobenzyl)aniline;
N,N',N''-tri(hexylbenzyl)-2,4-bis-(aminobenzyl)aniline; and so forth.

The preparation of these materials is not novel and suitable methods will be recognized by those skilled in the art. One preparative route is the condensation of the bis-(p-aminobenzyl)aniline with an aromatic or heteroaromatic aldehyde or ketone, or mixtures of such aldehydes or ketones, to afford the Schiff base, or imine, followed by reduction. Typically, such a reaction is conducted in an inert solvent, such as an aliphatic or aromatic hydrocarbon or ether, especially ethers of glycols and polyglycols, in the presence of an acid as catalyst, frequently p-toluenesulfonic acid or a similar acid, or Lewis acids, such as boron trifluoride, with subsequent recovery of the imine as product. Catalyst concentration may vary from about 0.1 to about 10 mole percent based on the least abundant reactant. Reaction temperatures from about 100° to about 150° C. are common. Subsequent hydrogenation may be effected with platinum group metal catalysts, nickel, and so on.

Alternatively, the materials of this invention may be prepared by reductive alkylation of the bis-(p-aminobenzyl)aniline by aromatic and heteroaromatic aldehydes or ketones. Usually an inert solvent, such as an aromatic hydrocarbon or an alcohol, or some combination of them, is used to dissolve the parent amine and the carbonyl compound. A small amount of a hydrogenation catalyst as previously described, but usually less than 20 mole percent, is added. The resulting mixture is then heated at 125°-150° C. under about 100 atm hydrogen for several hours.

The materials described herein may be used as antioxidants in a wide variety of petroleum and petroleum-related products, and are particularly useful in inhibiting oxidation in hydrocarbon oils. For example, the materials may be used in lubricating oils and greases, either of synthetic or petroleum origin. Examples, cited for illustrative purposes only, include aliphatic esters, polyalkylene oxides, silicones, fluorine-substituted hydrocarbons, and the like. Lubricating oils of petroleum origin include motor lubricating oil, railroad type lubricating oil, marine oil, transformer oil, transmission oil, turbine oil, gear oil, differential oil, diesel lubricating oil, hydraulic oil, cutting oil, rolling oil, etc. Greases include petroleum grease, whale grease, wool grease, grease from inedible and edible fats, synthetic greases, such as those from mineral or synthetic oils containing hydrocarbon-soluble metal salts of fatty acids, and so forth. The materials of this invention also are suitable for the stabilization of plastics and rubbers obtained from polymerization of various petroleum-derived materials, such as polyethylene, polypropylene, polybutadiene, polystyrene, copolymers of ethylene and butadiene, and the like, polyacrylonitrile, polyacrylates, and so forth.

The antioxidants described within also find use as oxidation inhibitors in fuel oils. Among the latter are included gasoline, diesel fuel, jet fuel, other aviation fuel, burner oil, furnace oil, kerosene, and naphtha. Of the compositions comprising a major amount of fuel oil and a minor amount of the additives herein, sufficient to inhibit oxidation, those compositions where the fuel oil is gasoline are especially preferred.

The materials may be effective as an antioxidant at levels as low as about 0.005 by weight. Higher concentrations, up to about 5% by weight, may be used if desired, although it will be recognized that it is economically advantageous to use these materials at as low a concentration as will be effective. The particular ranges of concentration depend somewhat on the particular use. For example, in lubricating oils the antioxidants herein may be used in the range from about 0.005 to about 5% by weight, with the range 0.05 to about 3% being more desirable, and the range 0.1 to about 2% being still more preferred. When the materials herein are used in fuel oils their concentration is reduced, being generally in the range from about 0.0005 to about 1% by weight, with the preferred range being from about 0.005 to about 0.5%.

The materials described in the examples are merely illustrative of this invention. It is to be understood that this invention is not to be limited thereto.

EXAMPLE 1

Preparation of N,N',N''-pyridinylmethyl-2,4-bis-(aminobenzyl)aniline. To a 300 ml glass liner was added 4.6 g (15.2 mmol) 2,4-bis-(4-aminobenzyl)aniline, 5.0 g (46.7 mmol) of 2-pyridine carboxaldehyde, 0.7 g Pt.$Al_2O_3$ and 60 ml toluene. Reaction mixture was a red-brown opaque mixture. After standing for 15 mins., it became a red-brown solution with water condensed on the sides and catalyst on the bottom. A pressure change of 6 atm $H_2$ was observed after heating for 10 h under 100 atm $H_2$ at 172°-8° C. After cooling to room temperature, the mixture was decanted; the residue was rinsed with toluene and added to the decantate. Concentration on a flash evaporator yielded a thick golden brown oil. Heat treatment under vacuum (10 mm Hg) produced a viscous oil (6.3 g). Spectral techniques were consistent with the assigned structure.

EXAMPLE 2

Preparation of N,N',N''-tribenzyl-2,4-bis-(4-aminobenzyl)aniline. In a 300 ml glass liner was dissolved 10.5 g (99.0 mmol) based on 2,4-bis-(4-aminobenzyl)aniline in 50 ml THF. Freshly distilled benzaldehyde (11.5 g, 108.5 mmol) was added, followed by 1 g of Pt/$Al_2O_3$. Reaction mixture became darker as it was heated to 170°-80° C. for 10 h under 100 atm $H_2$. After a pressure decrease of about 10 atm the reaction mixture was cooled to room temperature. Most of the material was a clear, golden brown liquid with a lower phase of catalyst and moisture. The reaction mixture was decanted to remove catalyst and concentrated on the flash evaporator. The thick, brown oily residue was azeotroped with toluene (3×30 ml) to a thick oil. Heat treatment under vacuum (0.3 mm Hg) removed residual traces of alcohol and unreacted benzaldehyde. The residue was a viscous brown oil (17.3 g). NMR & IR support the structural assignment.

EXAMPLE 3

Preparation of N,N',N''-tri-(2-butyl)-2,4-bis-(aminobenzyl)aniline. Reductive alkylation of 2,4'-bis-(4-aminobenzyl)aniline (3.0 g, 28.3 mmol) in 50 ml of 2-butanone was accomplished using 0.5 g Pt.$Al_2O_3$ and heating for 10 h at 160.5° C. under 67 atm $H_2$. After a pressure drop of 14 atm, the golden brown homogeneous solution was cooled to room temperature, filtered by suction to remove catalyst and concentrated on a flash evaporator. The viscous orange brown residue is azeotroped with cyclohexane and concentrated under reduced pressure to yield a thick orange brown oil. Spectral assignments are consistent with the structure.

EXAMPLES 4–13

A standardized test was used to screen the suitability of particular compounds as a stable antioxidant. Air at a constant rate of 50 ml per minute was bubbled through the test oil (a bright stock) which was held at 275° F. in a thermostatically heated aluminum block. The test oil, to which was added the potential antioxidant, was contained in a large test tube with metal coupons of aluminum, brass, copper, and steel. Heating time for the test was a minimum of five days, but was continued until the oil spot test indicated that the test sample had significantly decomposed. Upon termination of the test the acid number (AN), change in the viscosity expressed as a percentage change (ΔV%), weight gain and weight loss of the coupons were determined. It has been found that the latter data are most significant for copper coupons, thus only these are reported herein.

The oil spot test consists of placing a drop of oil on a chromatography sheet. The appearance of the brown spot with a distinct perimeter or a spot with material at the center or with a definite ring indicates significant decomposition of the base oil. This was used to determine the length of the test subject to a five-day minimum time.

The results of testing are summarized in the accompanying table.

TABLE 1

PERFORMANCE OF ADDITIVES AS ANTIOXIDANTS - HIGH TEMPERATURE

| Example | Additive[a,b] | OS[c] | L[d] | AN[e] | Cu[f] | V %[g] |
|---|---|---|---|---|---|---|
| 4 | None | 3 | 124 | 4.62 | 7.3 | 27.0 |
| 5 | A = $CH(CH_3)_2$ | 5 | 144 | 0.60 | 4.1 | 10.9 |
| 6 | A = $C_6H_5CH_2$ | 5 | 144 | 0.39 | 2.1 | 8.8 |
| 7 | None | 4 | 124 | 5.56 | 9.3 | 37.7 |
| 8 | Ethyl 702[h] | 6 | 172 | 2.83 | 3.8 | 17.3 |
| 9 | A = 2-pyridinylmethyl | 7 | 172 | 0.12 | 0.12 | 3.4 |
| 10 | None | 3 | 124 | 4.96 | | 29 |
| 11 | Ethyl 702[h] | 7 | 190 | 3.56 | | 26 |
| 12 | A = 3-pyridinylmethyl | 11 | 266 | 0.52 | | 4 |
| 13 | A = 4-pyridinylmethyl | 11 | 262 | 0.42 | | 5 |

[a]All additives are at 0.5 weight percent.
[b]Additives have formula shown, vide supra, with A being designated in this column.
[c]Oil spot test; time in days to onset of sludging.
[d]Duration of test in hours.
[e]Acid number, ASTM D-974.
[f]Weight loss in milligrams.
[g]Percent change in kinematic viscosity at 100° F.
[h]A commercial product from Ethyl Corporation.

EXAMPLES 14–16

The effectiveness of materials as antioxidants in fuel oils was determined by measurement of the induction period prior to oxidation, ANSI/ASTM Method 525-74. The liquid petroleum product was a base washed, blended full range gasoline. Test results for various compositions are listed in Table 2. As a comparison, there is included an antioxidant of wide commercial utility which consists of 2,6-di-t-butylphenol (75%), 2,4,6-tri-t-butylphenol (15%), and 2-t-butylphenol (10%) and which we designate by the symbol E733.

TABLE 2

| Example | Additive[a] | Concentration, ppm | Induction period[a] in minutes |
|---|---|---|---|
| 14 | None | | 340 |
| | A = 2-pyridinyl | 5 | 355 (390) |
| | | 10 | 355 (425) |
| | | 20 | 365 (495) |
| 15 | None | | 380 |
| | A = benzyl | 5 | 335 (345) |
| | | 10 | 385 (380) |
| | | 20 | 445 (450) |
| 16 | None | | 425 |
| | A = isopropyl | 5 | 430 (470) |
| | | 10 | 425 (520) |
| | | 20 | 390 (570) |

[a]Additives have formula shown, vide supra, with A being designated in this column.
[b]Figures in parenthesis refer to results with E733 at the same concentration.

Thus the data of Table 2 clearly show that some antioxidants of this invention are comparable to the material which is used as the commercial benchmark for fuel oil antioxidants.

What is claimed is:

1. A method of inhibiting oxidation in lubricating oils and greases comprising adding to said products an amount effective to inhibit oxidation of a bis-(p-aminobenzyl)aniline with the structure

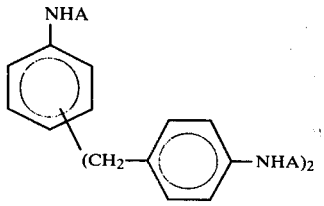

where A is selected from the group consisting of arylmethyl or heteroarylmethyl moieties of the formula —$CH_2X$, where X is a monovalent radical whose parent is an aromatic or heteroaromatic ring.

2. The method of claim 1 wherein said lubricating oils and greases are synthetic or of petroleum origin.

3. The method of claim 1 wherein the bis-(p-aminobenzyl)aniline is a 2,4-bis-(p-aminobenzyl)aniline.

4. The method of claim 1 where A is an arylmethyl group, —$CH_2X$, X being a monovalent radical whose parent is an aromatic ring.

5. The method of claim 4 where the parent is benzene or a substituted benzene.

6. The method of claim 1 where A is a heteroaromethyl moiety, —$CH_2X$, X being a monovalent radical whose parent is an aromatic heterocyclic ring.

7. The method of claim 6 where X is a monovalent radical whose parent is selected from the group consisting of pyridine, thiophene, pyrrole, furan, imidazole, oxazole, thiazole, quinoline, and carbazole.

8. The method of claim 7 where the parent is pyridine.

9. The method of claim 7 where the parent is furan.

10. The method of claim 7 where the parent is thiophene.

11. The method of claim 1 where the amount of said material is from about 0.005 to about 5 percent by weight.

12. A composition comprising a major amount of a lubricating oil or grease and a minor amount sufficient to inhibit oxidation of a bis-(p-aminobenzyl)aniline with the structure

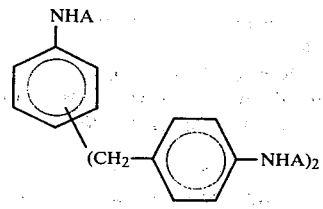

where A is selected from the group consisting of arylmethyl or heteroarylmethyl moieties of the formula —$CH_2X$, where X is a monovalent radical whose parent is an aromatic or heteroaromatic ring.

13. The composition of claim 12 wherein said lubricating oil or grease is synthetic or of petroleum origin.

14. The composition of claim 12 wherein the bis-(p-aminobenzyl)aniline is a 2,4-bis-(p-aminobenzyl)aniline.

15. The composition of claim 12 where A is an arylmethyl group, —$CH_2X$, X being a monovalent radical whose parent is an aromatic ring.

16. The composition of claim 15 where the parent is benzene or a substituted benzene.

17. The composition of claim 12 where A is a heteroaromethyl moiety, —$CH_2X$, X being a monovalent radical whose parent is an aromatic heterocyclic ring.

18. The composition of claim 17 where X is a monovalent radical whose parent is selected from the group consisting of pyridine, thiophene, pyrrole, furan, imidazole, oxazole, thiazole, quinoline, and carbazole.

19. The composition of claim 18 where the parent is pyridine.

20. The composition of claim 18 where the parent is furan.

21. The composition of claim 18 where the parent is thiophene.

* * * * *